US008469468B2

(12) United States Patent
Chen et al.

(10) Patent No.: US 8,469,468 B2
(45) Date of Patent: Jun. 25, 2013

(54) SLIDE ASSEMBLY WITH BUFFERING DEVICE

(75) Inventors: Ken-Ching Chen, Kaohsiung Hsien (TW); Xue-Long Liu, Kaohsiung Hsien (TW); Yi-Syuan Jhao, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 365 days.

(21) Appl. No.: 12/879,276

(22) Filed: Sep. 10, 2010

(65) Prior Publication Data

US 2012/0062088 A1 Mar. 15, 2012

(51) Int. Cl.
*A47B 88/04* (2006.01)

(52) U.S. Cl.
USPC ..... 312/333; 312/334.47; 312/319.1

(58) Field of Classification Search
USPC ..... 312/330.1, 319.1, 333, 334.1, 334.7, 312/334.8, 334.44, 334.46, 334.47; 384/20, 384/21, 22
See application file for complete search history.

(56) References Cited

U.S. PATENT DOCUMENTS

| | | | | |
|---|---|---|---|---|
| 5,040,833 | A | 8/1991 | Brunnert | |
| 7,347,515 | B1 | 3/2008 | Lu | |
| 7,374,261 | B1 | 5/2008 | Wang | |
| 7,413,270 | B2 | 8/2008 | Chang et al. | |
| 7,537,296 | B2 | 5/2009 | Leon et al. | |
| 8,256,853 | B2 * | 9/2012 | Chen et al. | 312/333 |
| 2009/0278430 | A1 * | 11/2009 | Liang et al. | 312/319.1 |

FOREIGN PATENT DOCUMENTS

| | | | |
|---|---|---|---|
| EP | 0743032 | B1 | 11/1996 |

* cited by examiner

*Primary Examiner* — James O Hansen
(74) *Attorney, Agent, or Firm* — Rosenberg, Klein & Lee

(57) ABSTRACT

A slide assembly with a buffering device includes a positioning member, a swing member, a push member, a resilient member and an engaging member, all of which are connected to the slide assembly having a first rail and a second rail. The positioning member is movably connected to the first rail and the swing member is pivotably connected to the positioning member. The push member is connected to the positioning member and biased by the resilient member so as to move longitudinally. The engaging member is connected to the second rail. A buffering member is located between the positioning member and the first rail. The buffering member maintains the positioning member at a first position relative to the first rail.

3 Claims, 8 Drawing Sheets

SLIDE ASSEMBLY WITH BUFFERING DEVICE

FIELD OF THE INVENTION

The present invention relates to a buffering device for a slide assembly, and more particularly, to a buffering device of a push-open type slide assembly.

BACKGROUND OF THE INVENTION

U.S. Pat. No. 7,374,261 to Wang discloses a push-open type slide structure which comprises a top fastener and a locking device mounted between an outer slide rail and a pull rod. The top fastener comprises a loading plate extending from one side of a center portion of the main body thereof. Two pillars extend from both sides of the main body respectively. An action trench is formed on a connection portion between the main body and the loading plate. The action trench is in communication with a holding trench on the backside of the main body. A second elastic device is mounted on the inside of said holding trench. The loading plate has a shaft hole and a slideway on a surface and slide rails on the backside of the loading plate. The positioning fastener has a shaft and a protrudent part on a bottom surface, a hook on an inner edge, and a guide pillar on a rear end. The shaft of the positioning fastener is held in the shaft hole. The protrudent part is exactly coupled with the inside of said slideway. The hook is inserted into said action trench of the main body and coupled with the second elastic device. The pair of first elastic device is sleeved onto the pillars of the main body. Two sleeves are mounted on both sides of the slide sleeve and coupled with the pair of first elastic devices respectively. The slide sleeve is coupled with a lower portion of the loading plate. The slide sleeve is slidable on the slide rails of the loading plate. The locking device is fixed on said pull rod. The locking device has a connection part for coupling with a guide part and a shaft holder. The guide part of the locking device has a guide edge, an inclined plane, and a recessed trench. The shaft holder has an edge protrusion spaced from the recessed trench by a certain distance so as to a form a tunnel.

However, when an impact, vibration or other type of exterior force is applied to the furniture that is equipped with the slide assembly, in other words, the slide assembly is abnormally opened, the slide assembly is applied by the above mentioned exterior force to suddenly unlock the locked status and the drawer un-expectably pops out.

SUMMARY OF THE INVENTION

The present invention intends to provide a slide assembly with a buffering device and the buffering device absorbs the vibration caused by the exterior force so that the drawer does not suddenly pop out.

The present invention relates to a slide assembly which comprises a first rail and a second rail which is longitudinally and slidably movable relative to the first rail. A positioning member is movably connected to the first rail and has a first end and a second end which is located opposite to the first end. A swing member is pivotably connected to the first end of the positioning member and has a pin. A push member is longitudinally and movably located between the first and second ends of the positioning member. A resilient member is located between the positioning member and the push member. An engaging member is connected to the second rail and has an engaging block located corresponding to the pin of the swing member. When the second rail is retracted relative to the first rail, the engaging block of the engaging member is engaged with the pin of the swing member. A buffering member is located between the positioning member and the first rail. The buffering member maintains the positioning member at a first position relative to the first rail. When the second rail is retracted relative to the first rail and applied by an exterior force, the positioning member is moved relative to the first rail and located at a second position. The buffering member is deformed for absorbing vibration force, and the engaging block of the engaging member is maintained to engage with the pin of the swing member at the second position.

Preferably, the positioning member includes an opening in which the buffering member is located. The first rail includes a stop portion with which the buffering member is in contact.

Preferably, the buffering member extends from an inner wall of an end of the opening and contacts the stop portion of the first rail. The buffering member is a curved and elongated resilient piece.

Preferably, the buffering member is a spring whose two ends respectively contact an inner wall of an end of the opening and the stop portion of the first rail.

Preferably, the first rail includes a stop portion which is located corresponding to the second end of the positioning member. The buffering member is located between the stop portion and the second end of the positioning member.

Preferably, the buffering member extends from the second end of the positioning member and contacts the stop portion of the first rail. The buffering member is a curved and elongated resilient piece.

Preferably, the buffering member is a spring whose two ends respectively contact the second end of the positioning member and the stop portion of the first rail.

Preferably, the first rail includes a stop portion which is located corresponding to the first end of the positioning member. The buffering member is located between the stop portion and the first end of the positioning member. The buffering member is a resilient member whose two ends respectively contact the stop portion of the first rail and the first end of the positioning member.

Preferably, the first end of the positioning member includes a connection portion to which the buffering member is connected.

The primary object of the present invention is to provide a buffering device of a slide assembly wherein the buffering device absorbs the vibration caused by the exterior force applied to the slide assembly to reduce the possibility of the retracted status of the slide assembly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
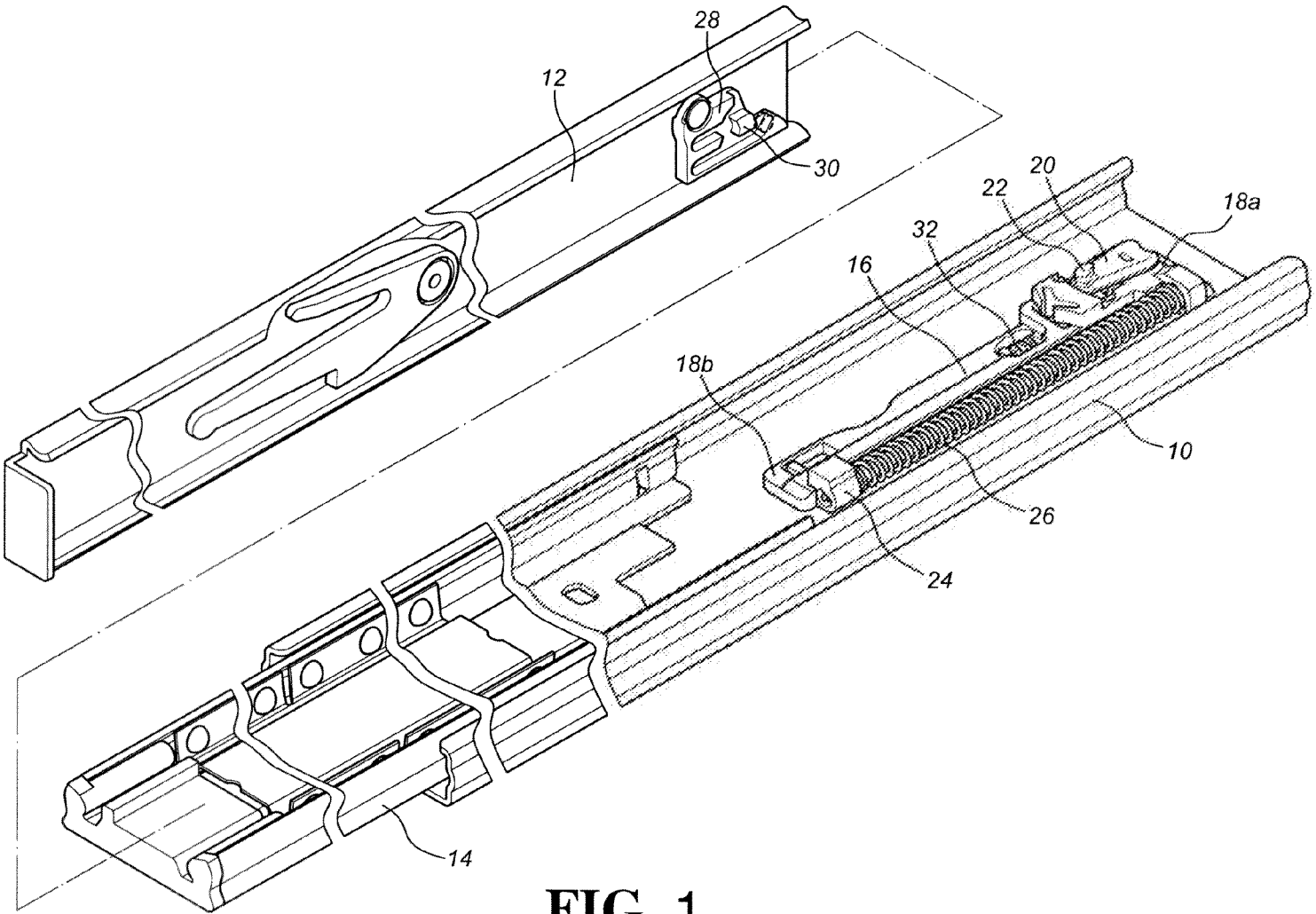
FIG. 1 is an exploded view to show the buffering device of the slide assembly in accordance with the first embodiment of the present invention.
Figure 2:
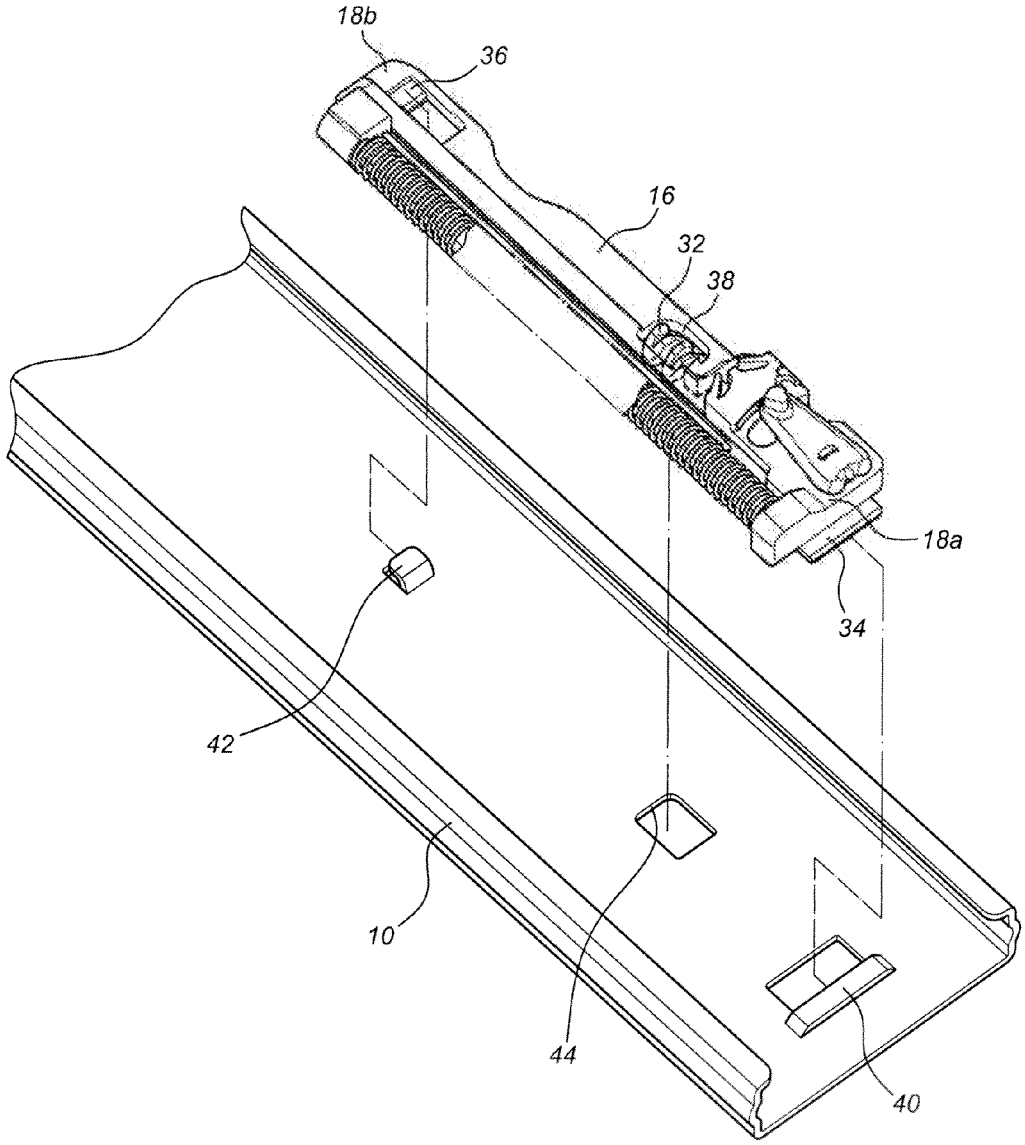
FIG. 2 shows that the buffering device is connected to the first rail of the slide assembly in accordance with the first embodiment of the present invention.
Figure 3:
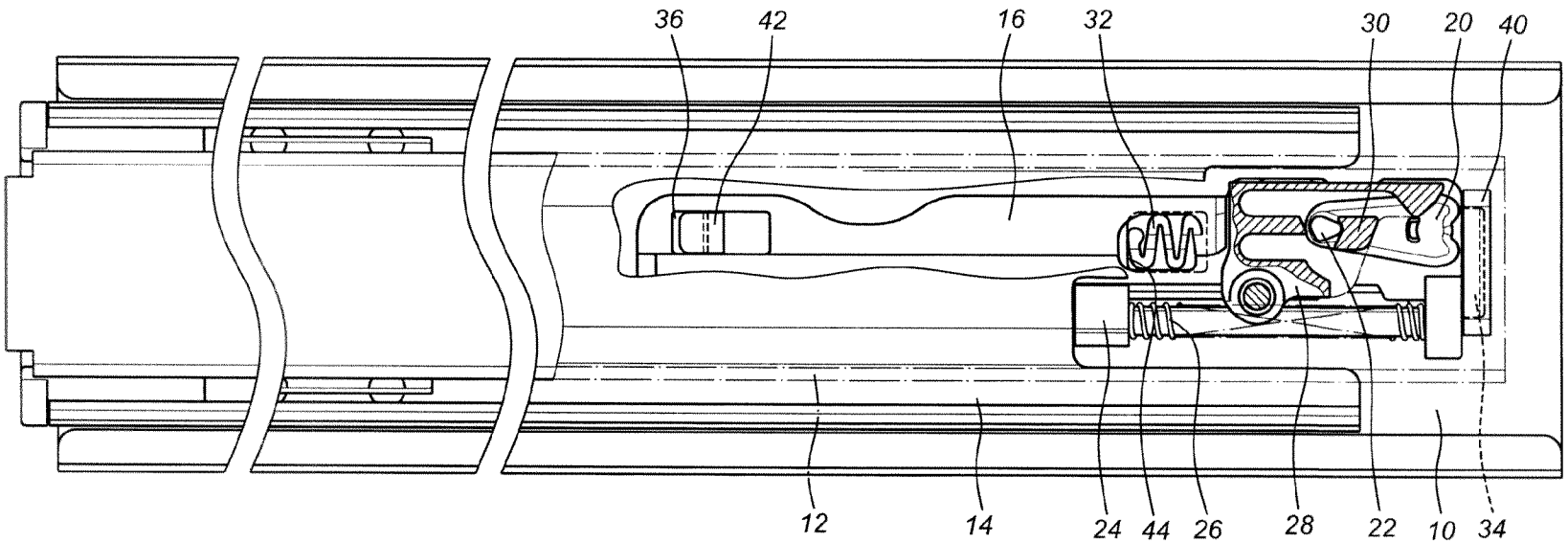
FIG. 3 shows the buffering device of the slide assembly in accordance with the first embodiment of the present invention, wherein the slide assembly is in a retracted status.

Referring to FIG. 1 to FIG. 3, the slide assembly of the present invention comprises a first rail 10, a second rail 12 longitudinally and slidably movable relative to the first rail 10, and a third rail 14 longitudinally and slidably connected between the first and second rails 10, 12. The second rail 12 is pulled a further distance by the relative movement of the third rail 14 to the first rail 10.

A positioning member 16 is movably connected to the first rail 10 and has a first end 18*a* and a second end 18*b* which is located opposite to the first end 18*a*. A swing member 20 is pivotably connected to the first end 18*a* of the positioning member 16 and has a pin 22. A push member 24 is longitudinally and movably located between the first and second ends 18*a*, 18*b* of the positioning member 16. A resilient member 26 is located between the positioning member 16 and the push member 24. An engaging member 28 is connected to the second rail 12 and has an engaging block 30 located corresponding to the pin 22 of the swing member 20. A buffering member 32 is located between the positioning member 16 and the first rail 10.

Referring to FIG. 2, the positioning member 16 includes a first connection piece 34 at the first end 18*a* and a second connection piece 36 is located at the second end 18*b*. The positioning member 16 further includes an opening 38 in which the buffering member 32 is located. The first rail 10 includes a first reception portion 40 located corresponding to the first connection piece 34 of the positioning member 16. The first rail 10 further has a second reception portion 42 located corresponding to the second connection piece 36 of the positioning member 16. The first rail 10 further has a stop portion 44 with which the buffering member 32 is in contact. Preferably, the buffering member 32 extends from an inner wall of an end of the opening 38 and contacts the stop portion 44 of the first rail 10. The buffering member 32 is a curved and elongated resilient piece.

Generally, the slide assembly is cooperated with a drawer connected to a cabinet (both are not shown). The first rail 10 is fixed to the cabinet and the second rail 12 is connected to the drawer. When the drawer is retracted into the cabinet, the second rail 12 is retracted relative to the first rail 10 as shown in FIG. 3. The engaging block 30 of the engaging member 28 on the second rail 12 is engaged with the pin 22 of the swing member 20 on the positioning member 16, and the push member 24 is pushed by the third rail 14 such that the resilient member 26 is compressed by the push member 24 and stores a force which applies to the push member 24 and the third rail 14. Therefore, the force of the resilient member 26 maintains the positions between the engaging member 28 of the second rail 12 and the positioning member 16. In addition, the first connection piece 34 of the positioning member 16 is movably engaged with the first reception portion 40 of the first rail 10, and the second connection piece 36 of the positioning member 16 is movably engaged with the second reception portion 42 of the first rail 10. The positioning member 16 is movably connected to the first rail 10. The buffering member 32 has one end contacting the stop portion 44 of the first rail 10, such that the positioning member 16 is maintained at a first position relative to the first rail 10 by the buffering member 32. At the first position, the engaging block 30 of the engaging member 28 is engaged with the pin 22 of the swing member 20.

Figure 4:
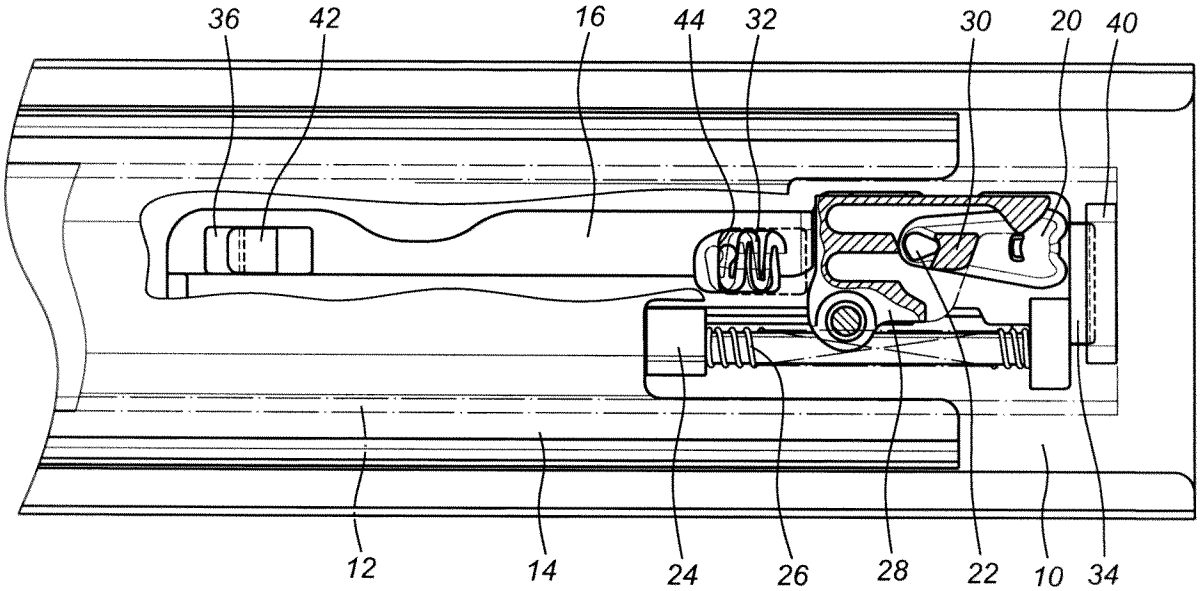
FIG. 4 shows the buffering device of the slide assembly in accordance with the first embodiment of the present invention, wherein the slide assembly is applied by an exterior force.

When a vibration, impact or any abnormal force is applied to the cabinet with the drawer having the slide assembly, in other words, the force is applied to the first rail 10, as shown in FIG. 4, the second rail 12 is located at the retracted position relative to the first rail 10. The first rail 10 is moved and the positioning member 16 is moved from the first position to a second position relative to the first rail 10. The deformation of the buffering member 32 absorbs vibration due to the movement of the first rail 10. In other words, the force is not transferred to the engaging member 28 on the second rail 12 via the positioning member 16, such that the second rail 12 (drawer) is not pushed relative to the first rail 10 (cabinet) unexpectedly. In other words, the engaging block 30 of the engaging member 28 on the second rail 12 is not disengaged or released from the pin 22 of the swing member 20 on the positioning member 16. Therefore, the engaging block 30 of the engaging member 28 on the second rail 12 is maintained at the position where the engaging block 30 is engaged with the pin 22 of the swing member 20.

Figure 5:
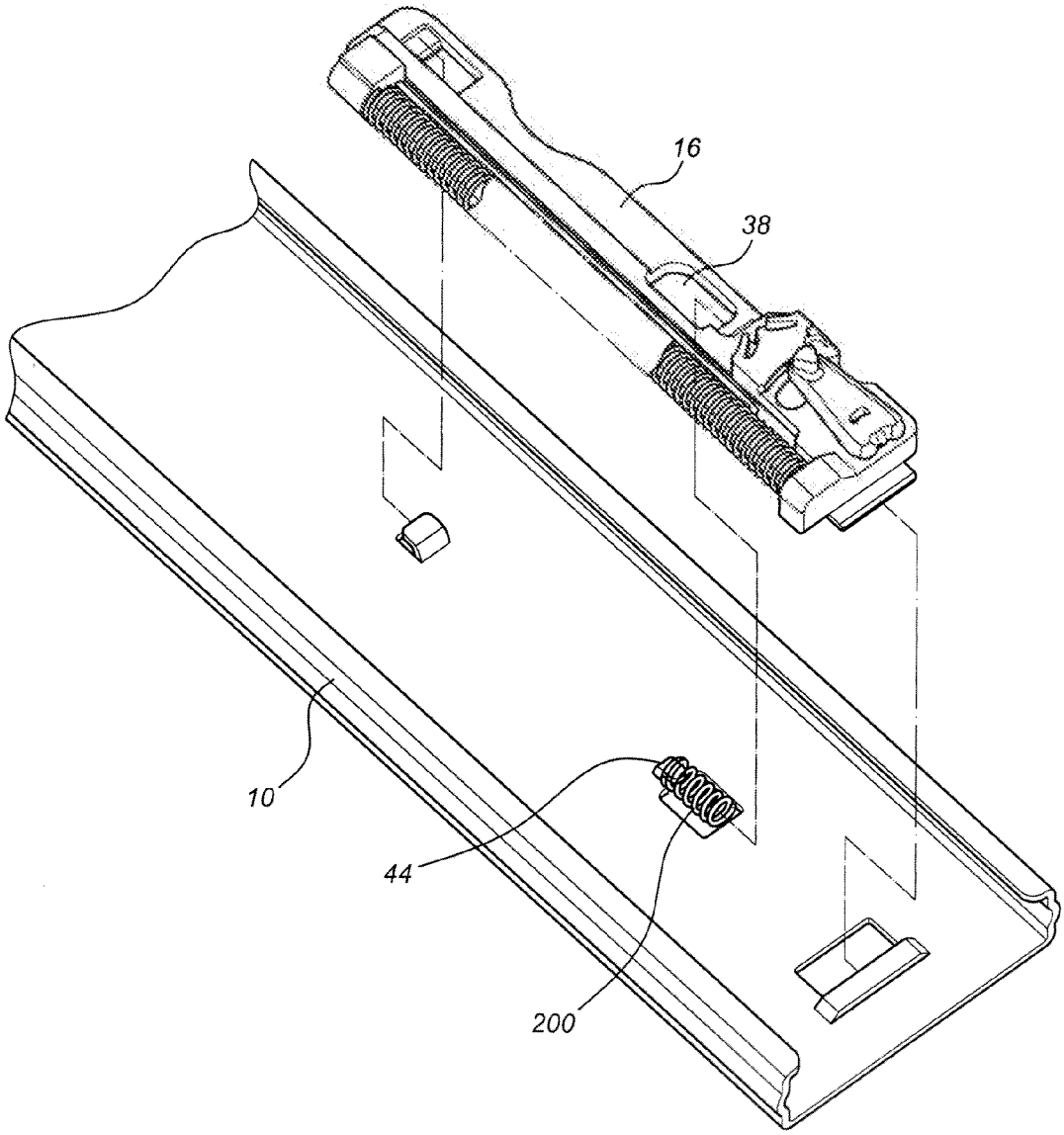
FIG. 5 shows that the second embodiment of the buffering device is connected to the first rail of the slide assembly of the present invention.

FIG. 5 shows that the buffering member 200 is a spring whose two ends respectively contact an inner wall of an end of the opening 38 and the stop portion 44 of the first rail 10.

Figure 6:
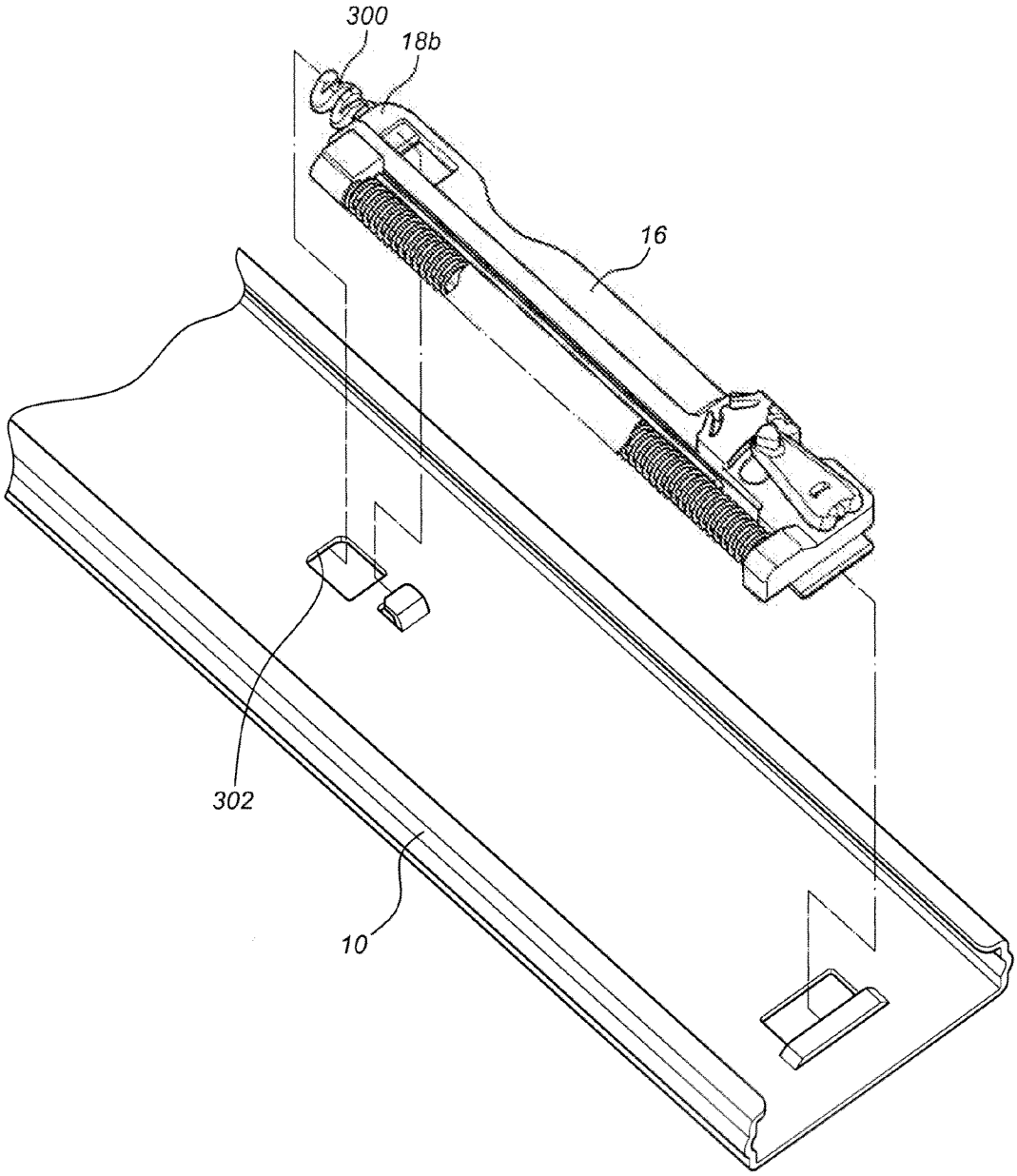
FIG. 6 shows that the third embodiment of the buffering device is connected to the first rail of the slide assembly of the present invention.

FIG. 6 shows that the first rail 10 includes a stop portion 302 which is located corresponding to the second end 18*b* of the positioning member 16. The buffering member 300 is located between the stop portion 302 and the second end 18*b* of the positioning member 16. Preferably, the buffering member 300 extends from the second end 18*b* of the positioning member 16 and contacts the stop portion 302 of the first rail 10. The buffering member 300 is a curved and elongated resilient piece.

Figure 7:
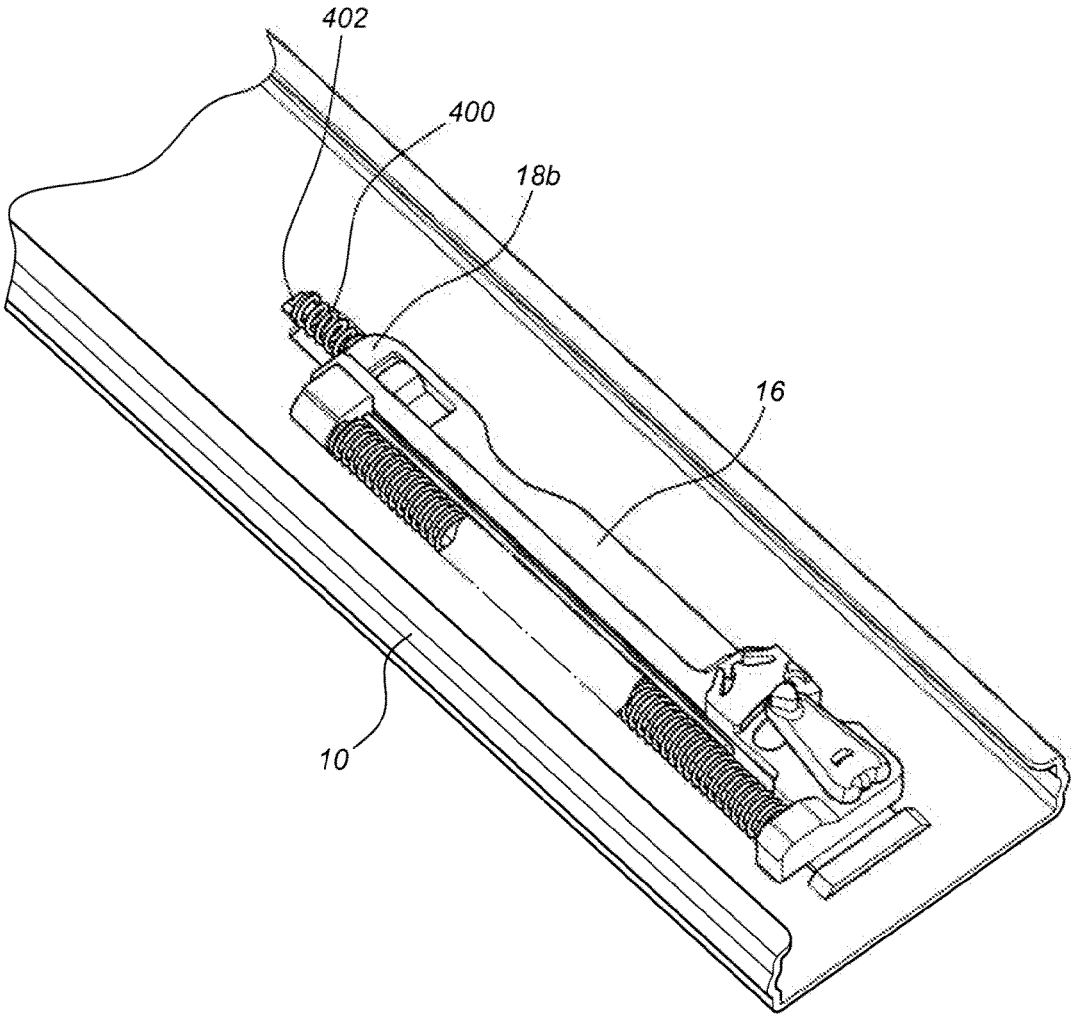
FIG. 7 is a perspective view to show that the fourth embodiment of the buffering device is connected to the first rail of the slide assembly of the present invention.

FIG. 7 shows that the buffering member 400 is a spring whose two ends respectively contact the second end 18*b* of the positioning member 16 and the stop portion 402 of the first rail 10.

Figure 8:
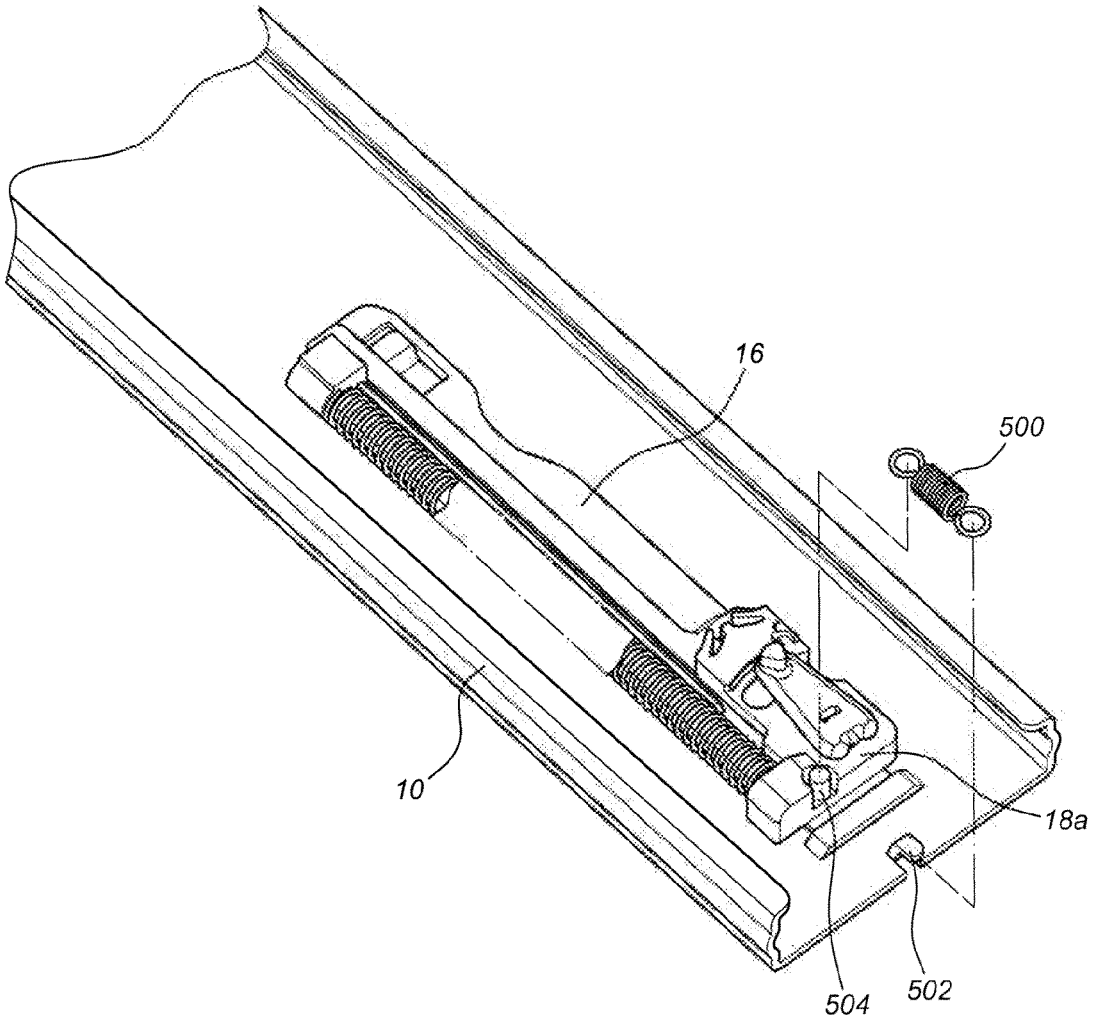
FIG. 8 is a perspective view to show that the fifth embodiment of the buffering device is connected to the first rail of the slide assembly of the present invention of the present invention.

FIG. 8 shows that the first rail 10 includes a stop portion 502 which is located corresponding to the first end 18*a* of the positioning member 16. The buffering member 500 is located between the stop portion 502 and the first end 18*a* of the positioning member 16. The buffering member 500 is a resilient member whose two ends respectively contact the stop portion 502 of the first rail 10 and the first end 18*a* of the positioning member 16. Preferably, the first end 18*a* of the positioning member 16 includes a connection portion 504 to which the buffering member 500 is connected.

While we have shown and described the embodiment in accordance with the present invention, it should be clear to those skilled in the art that further embodiments may be made without departing from the scope of the present invention.

What is claimed is:

1. A slide assembly with a buffering device, comprising:

a first rail;

a second rail longitudinally and slidably movable relative to the first rail;

a positioning member movably connected to the first rail and having a first end and a second end which is located opposite to the first end;

a swing member pivotably connected to the first end of the positioning member and having a pin;

a push member longitudinally and movably located between the first and second ends of the positioning member;

a resilient member located between the positioning member and the push member;

an engaging member connected to the second rail and having an engaging block located corresponding to the pin of the swing member, when the second rail is retracted relative to the first rail, the engaging block of the engaging member is engaged with the pin of the swing member; and a buffering member located between the positioning member and the first rail, the buffering member maintaining the positioning member at a first position relative to the first rail;

when the second rail is retracted relative to the first rail and applied by an exterior force, the positioning member is moved relative to the first rail and located at a second position, the buffering member is deformed for absorbing vibration force, the engaging block of the engaging member is maintained to engage with the pin of the swing member at the second position;

wherein the positioning member includes an opening in which the buffering member is located, the first rail includes a stop portion with which the buffering member is in contact.

2. The slide assembly as claimed in claim 1, wherein the buffering member extends from an inner wall of an end of the opening and contacts the stop portion of the first rail, the buffering member is a curved and elongated resilient piece.

3. The slide assembly as claimed in claim 1, wherein the buffering member is a spring whose two ends respectively contact an inner wall of an end of the opening and the stop portion of the first rail.

* * * * *